United States Patent [19]

Ferdelman et al.

[11] 3,974,661

[45] Aug. 17, 1976

[54] SUBBASE FOR ROOM AIR CONDITIONER WALL SLEEVE

[75] Inventors: Donald C. Ferdelman; John H. Loos, both of Dayton, Ohio

[73] Assignee: General Motors Corporation, Detroit, Mich.

[22] Filed: Apr. 21, 1975

[21] Appl. No.: 570,001

[52] U.S. Cl. ..... 62/262

[51] Int. Cl.[2] ..... F25D 23/12

[58] Field of Search ..... 62/262, 259; 98/94

[56] References Cited

UNITED STATES PATENTS

| | | | |
|---|---|---|---|
| 1,975,859 | 10/1934 | Nelson | 62/262 |
| 2,105,205 | 1/1938 | Steinfeld et al. | 62/262 |
| 3,225,561 | 12/1965 | Hall, Jr. | 62/262 |

*Primary Examiner*—Lloyd L. King
*Attorney, Agent, or Firm*—Edward P. Barthel

[57] ABSTRACT

A room air conditioner wall sleeve and subbase assembly for a 277 voltage range permanently wired installation located in a room wall opening. The subbase casing has a pair of side-by-side removable covered openings providing access to separate enclosures, one of which encases an electrical outlet receptacle for the power cord plug of the air conditioner chassis while the other enclosure encases the permanent field or "hard" wiring connection for the installation. The access cover for the power cord receptacle enclosure has a self-contained outwardly formed shield, including an upwardly extending portion that defines, with the sleeve front flange and sleeve front assembly, a convenient code approved electrical duct passage for encasing the power cord.

3 Claims, 4 Drawing Figures

SUBBASE FOR ROOM AIR CONDITIONER WALL SLEEVE

This invention pertains to room air conditioning electrical installation apparatus and more particularly to a field wired subbase adapted to be mounted on the underside of a room air conditioner wall sleeve to provide a permanent electrical installation for the air conditioner chassis adapted to be removably located within the sleeve.

The present invention provides an improved electrical wiring subbase casing adaptable for a wide variety of installation arrangements for room air conditioners such as, for example, units that provide cooling and heating comfort from a 277 volt power supply used primarily in motels, hotels, office buildings, industrial plants, etc. The present invention is an improvement over the mounting assembly disclosed in U.S. Pat. No. 3,225,561 issued Dec. 28, 1965 to W. B. Hall, Jr. and assigned to the assignee of the present application.

It is an object of the present invention to provide an improved factory wired electrical subbase casing having both a power cord plug-in receptacle connector enclosure and a field wiring enclosure incorporated in a subbase which subbase can be detachably secured to an air conditioner wall sleeve to provide a permanent field wiring connection for the air conditioner chassis allowing same to be readily installed or replaced for service in the wall sleeve wherein the power plug receptacle arrangement obviates the need to disconnect the building main electrical power source.

It is another object of the present invention to provide an improved air conditioner wall sleeve and permanently wired electrical subbase casing assembly wherein the casing includes side-by-side first and second metal enclosures with the first enclosure providing a factory wired power plug receptacle and the second enclosure providing a field wiring enclosure for permanent hand wiring electrical installation when located in the wall opening. The casing side-by-side enclosure openings are concealed by separate access covers with the cover for the receptacle enclosure having an integral outwardly convex shield including an upwardly extending portion whereby the shield cooperates with the sleeve front angulated flange and the sleeve front assembly to provide a vertical passageway or duct means for receiving the power cord from the air conditioner chassis control box such that, with the power cord plugged into the receptacle and the access cover and front assembly secured by threaded fasteners, the power cord and plug are concealed and inaccessable except by means of a screwdriver in accordance with Underwriters Laboratories, Inc. requirements.

Further objects and advantages of the present invention will be apparent from the following description, reference being had to the accompanying drawings wherein a preferred embodiment is clearly shown.

Figure 1:
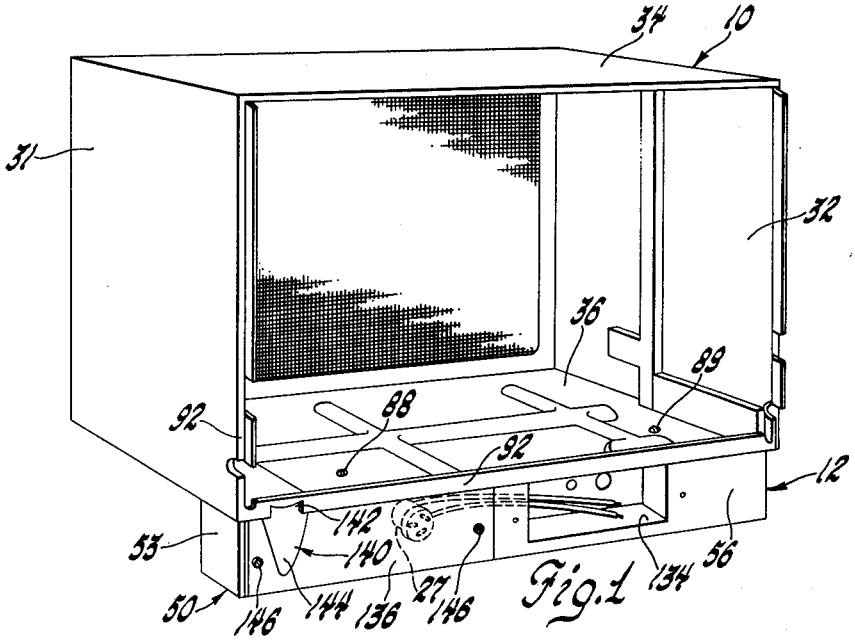
FIG. 1 is an overall perspective view of a room air conditioner sleeve and subbase assembly with the air conditioner chassis removed.
Figure 2:
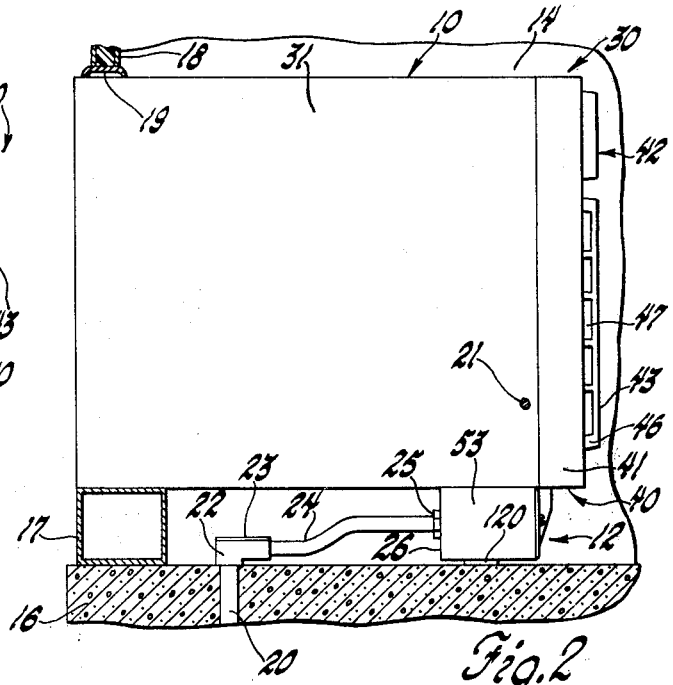
FIG. 2 is a vertical elevational view partly in section including a sectional view portion of the floor and the wall of a room.

Referring now to the drawings, there is shown in FIG. 1, a room air conditioner sleeve and subbase assembly for mounting an air conditioner chassis in a window or wall opening of the enclosure to be conditioned. The installation assembly includes the rectangular sectioned cabinet wall sleeve, generally indicated by numeral 10, having its room side front opening 11 (FIG. 3) supported on the combined electrical and structural subbase generally indicated at 12. As seen in FIG. 2, the assembly is installed in a room, a portion of which is shown at 14, which may be provided with any suitable type of floor such as a concrete slab floor 16 having box-shaped sills 17 which support a thin vertical insulating wall 18, commonly referred to as a curtain wall, to define a wall opening 19. For the electrical supply, the conductors extend from suitable remote electrical control devices through steel pipe 20 to a right angle fitting 22, having a removable top 23, and thence through a second rigid conduit such as a steel pipe 24 to a conventional conduit connector 25 located in outer rear wall 26 of the subbase 12.

The disclosed room air conditioner mounting assembly is intended for building installations having a 277 voltage range supply that may vary ± 10% (minimum 250 volts maximum 305 volts), such as furnished for example by a three phase 480 volt installation providing single phase 277 voltage. One model of room air conditioner for such a through-the-wall installation typically furnishes cooling and heating thereby providing All Seasons comfort, and finds its primary use in hotels, motels, offices, industrial plants, etc. In such installations, it is preferred to install a separate specially engineered wall sleeve and base, as generally taught in the above-mentioned Hall patent. To this end, applicants' improved subbase casing provides side-by-side electrical attachment and wiring enclosures with one of the enclosures permitting access to a plug-in power cord receptacle 27 for mating with the chassis power cord plug 28 while the remaining enclosure provides for a permanent field wired connection. In this way the air conditioner wiring will be in accordance with the National Electrical Code and Underwriters Laboratories specifications together with pertinent local requirements, as they exist. The Code requires a field or hard wired permanent installation wherein the wiring is all encased in metal and accessable only by the use of tools for removing covering members such as threaded fasteners removable by the use of a screwdriver.

The present cabinet subbase casing and electrical subbase 12 is a factory built unit which allows for in-plant factory wiring and equivalent additional field wiring during installation in accordance with the National Electrical Code. Thus, when the subbase is assembled in the field with the wall sleeve and installed in the room wall opening 19, the assembly is ready for field wiring to provide a permanent installation. The air conditioner chassis, as shown for example in U.S. Pat. No. 3,792,593 issued to J. A. Loathes et al, may be inserted in the wall sleeve 10 and electrically connected by its relatively short power cord 29 and plug 28 being directed into the lefthand opening of the subbase and plugging the power plug 28 into its mating receptacle 27 after which, with the access cover in place, the air conditioner front assembly 30 may be installed over the sleeve front opening 11 and secured by screws to the sleeve as shown at 21 in FIG. 2. For a detailed description of a typical front assembly for a room air conditioner reference may be had to the U.S. Pat. No. 3,592,123 issued to Henken et al and assigned to the same assignee as the present application, the disclosure of which is incorporated by reference herein.

As seen in FIGS. 1 and 2, the wall sleeve 10 has two sides 31 and 32 and a connecting top wall 34 which surround the sides and top of a room air conditioner chassis which chassis may be slidably mounted on sleeve base wall 36. The front opening 11 of the sleeve together with the chassis are concealed to a limited extent and enclosed by the front assembly 30 including a cabinet front, generally indicated at 40 in FIG. 2, which includes a rectangular frame 41 closing an upper grill assembly 42 and a lower sliding baffle 43. The grill assembly 42, as disclosed in the Henken patent, occupies a position aligned with the outlet duct and may include a series of adjustable vanes for controlling the air being discharged therethrough.

Figure 3:
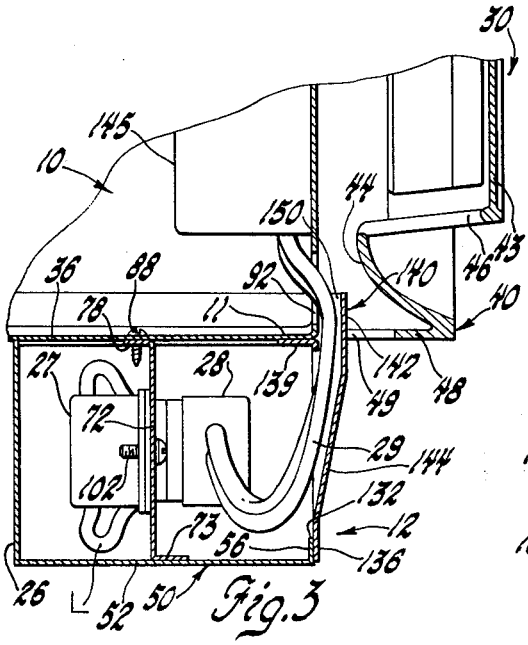
FIG. 3 is an enlarged fragmentary vertical view through the subbase at the receptacle access cover integral shield.

As seen in FIG. 3 the front 40 includes a peripheral cabinet connection channel 44 having reinforcing ribs 46. The assembly frame 41 has appreciable depth so that the panel supporting frame provides space in front of the sleeve 10 sufficient for the required air flow into the chassis inlet duct without undue resistance. To accommodate the air flow there are included a number of vertically and horizontally spaced side and top air inlet openings 47 which admit air to be conditioned into the space in front of the evaporator and permit the use of the imperforate decorative front baffle panel 43, which is preferably slidably mounted in the peripheral frame. Also, as seen in FIG. 3, the frame bottom portion 48 has elongated rectangular openings 49 provided therein allowing for additional air to pass through and into the chassis.

Figure 4:
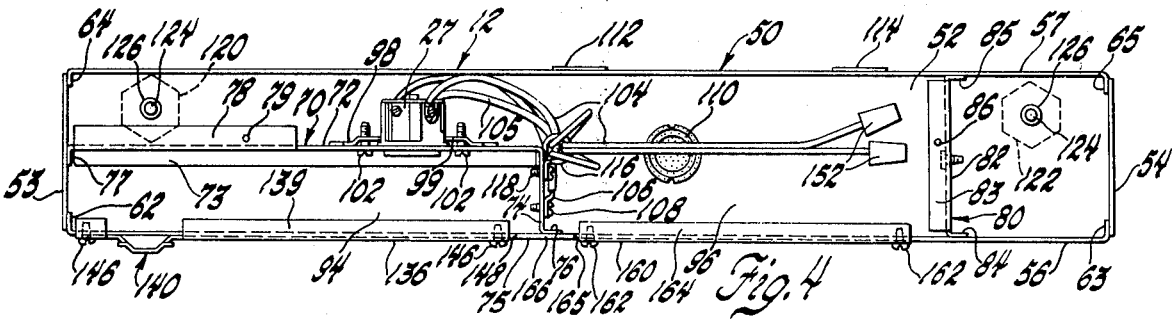
FIG. 4 is an enlarged top plan view of the subbase.

Referring now to FIGS. 3 and 4 the illustrative subbase casing 12 comprises a three-piece structural assembly in which the major open-top box shell, generally indicated at 50, is originally formed from a one-piece flat blank of sheet metal (not shown) which includes the rectangular flat bottom or base panel 52 having end panels 53 and 54 extending vertically from the ends of the base panel 52. Each end panel 53, 54 extends right-angularly upwardly from the base panel 52 and has a generally rectangular shape. An integral room-side front panel 56 and rear panel 57 extend upwardly at right angles from the front and rear edges of the bottom base panel 52, respectively. As seen in FIG. 4 the rear and front panels 56 and 57 have inwardly extending right angular side edge flanges 62, 63 and 64, 65 respectively, which abut the corresponding marginal areas of the end panels 53 and 54, and are attached thereto in a suitable manner, as by welding, to complete the formation of the integral sheet metal subbase box shell 50.

The second element of the box shell 50 is in the form of an L-shaped partition member, generally indicated at 70 in FIG. 4, including a first partition wall 72 extending from the lefthand end panel 53 in intermediate parallel relation to the front and rear panels 56 and 57; and extending longitudinally a distance of about one-half the overall length of the box shell. The first partition wall 72 includes a bottom flange 73 which is preferably welded to the bottom panel 52. The L-shaped partition member 70 has a second wall 74, extending forwardly at right angles from the first wall 72, for attachment to the inner face of front panel intermediate mullion or dividing plate 75 by means of a right-angled attaching flange 76 secured as by welding to the inner face of plate 75. The first partition wall 72 includes an attaching flange 77, secured by welding to the end panel 53, and a right-angled rearwardly extending lefthand top flange 78 located flush with the upper edges of the shell 50 with the top flange including a threaded opening 79.

A third element of the box shell is a partition member, generally indicated at 80, located in spaced parallel relation to righthand end panel 54. The partition member 80 includes a transverse wall 82 having an inwardly extending right-angled top flange 83, located coplanar with top flange 78. Member 80 includes front and rear inwardly extending attaching flanges 84 and 85 respectively, secured, preferably by welding, to their associated front and rear panels 56 and 57. The partition member top flange 83 includes a threaded hole 86 aligned on a common transverse axis with L-shaped partition hole 79.

As seen in FIGS. 1 and 3, the right and lefthand top flanges 78 and 83 respectively abut the sleeve bottom wall 36 such that the subbase casing 12 may be detachably secured thereto by suitable fastening means such as metal flat-head screws 88 and 89 threadably received in their corresponding threaded openings 79 and 86. It will be noted that the subbase casing is positioned to extend the full width of the sleeve bottom wall 36 and with its front wall 56 located in substantially flush coplanar relation with the angulated bottom flange 92 of the air conditioner sleeve.

As viewed in FIG. 4, the L-shaped partition wall 70 divides the box shell into side-by-side enclosures or chambers in the form of a lefthand power cord and electrical plug receiving chamber 94 and a field wiring enclosure 96 being L-shaped in horizontal section. The electrical three-prong receptacle 27, for receiving the service cord plug 28, extends through an aperture in the first partition leg 72 and is mounted thereto by a receptacle bracket 98 having an offset base portion 99 generally parallel to the partition 72 to which are tapped a pair of screws 102. As illustrated, all of the internal leads 104, 105 and 106, which are located in L-shaped enclosure 96, are connected to the receptacle 27 with lead 106 providing a ground wire to the box shell 50 by means of the terminal screw member 108 which is in electrical contact with the second partition leg 74. As seen in FIG. 4, both the base panel 52 and the rear panel 57 are provided with conventional knock-out holes or plugs communicating with the L-shaped field wiring enclosure 96. Specifically, knock-out plug 110 is located in base panel 52 while a pair of knock-out plugs 112 and 114 are in the rear panel 57. The electrical leads 104 and 105 are shown looped through a strain relief clamp 116 secured to second partition leg 74 by a screw 118.

As seen in FIGS. 2 and 4, a pair of adjustable glider buttons 120 and 122 are located on the bottom panel 52 adjacent each end thereof and include vertical adjusting threaded members 124 connected in threaded nut members 126. The glider buttons serve to assure the proper slope of the air conditioner sleeve for condensate removal while providing added support for the subbase casing.

Both the receptacle enclosure 94 and the field wiring enclosure 96 have their front rectangular openings 132 and 134 respectively, closed by separate access covers. The receptacle enclosure access cover 136 has a top right-angular flange 139 and includes an integral shield-like portion 140 formed with an upper winged extension 142 lanced from its flange 139 to form a continuation of its lower outwardly bowed triangular-shaped embossment 144 portion of the shield formed in the access cover plate 136.

By virtue of this arrangement the air conditioner service cord 29 is of a predetermined length wherein it extends downwardly from the chassis control box 145 through the access opening 132 and into the receptacle enclosure 94 where its plug 28 is plugged directly into the grounded three-prong receptacle 27 after which the access cover 136 may be secured by screws 146 with its shield portion 140 forming a vertical wire duct passage 150 with sleeve bottom flange 92 communicating with the enclosure 94. Upon the front assembly 30 being secured over the front opening 11 of the sleeve, it will be appreciated that the service cord 29 and plug 28 are concealed in a permanently wired fashion to prevent any inadvertent contact or tampering therewith in accordance with the National Electrical Code. The upper edges of the front wall panel 56 are notched or recessed at 148 to receive the top flange 139 of access cover 136 such that the top flange 139 thereof is flush with the upper edges of the box shell 50.

Prior to the air conditioner chassis insulation, the enclosed leads 104 and 105 in the field wiring chamber are connected to corresponding outer power leads in the conduit 24 such as by twist-on type connectors 152. In the form the invention disclosed the leads 104 and 105 are attached to conduit outside wires extending through the rear panel knock-out 114. It will be appreciated, however, that by means of applicant's arrangement the subbase leads 105 and 106 may be connected to rigid conduit enclosed outside leads attached to either the pair of rear wall knock-outs or the bottom wall knock-outs 110.

After the leads have been field wired access cover 160 is secured to the front wall panel 56 by screws 162. The access cover 160 has a top right angled flange 164 that is received in top recess 165 in front wall panel 56 such that the right hand access cover top flange 164 is flush with the upper edge 166 of the front wall panel 56.

While the embodiment of the present invention as herein disclosed constitutes a preferred form, it is to be understood that other forms might be adopted.

We claim:

1. An electrical subbase support casing for mounting the room-side end of an air conditioner wall sleeve upon a surface, said casing including an elongated box-shaped shell coextensive with the sleeve width formed from a one-piece blank of sheet metal comprising a rectangular base having upstanding end panels, a rear panel and a front panel; an L-shaped partition supported in said casing having a first wall extending from one end panel in intermediate parallel relation to said front and rear panels, said L-shaped partition having a second transverse wall extending forwardly from said first wall for attachment to said front panel, said L-shaped partition dividing said shell into a receptacle enclosure and a field wiring enclosure, said first wall having one-half of an electrical receptacle fixed thereto whereby a power cord plug from the control box of an air conditioner chassis is adapted to be connected with said receptacle, said front panel having side-by-side access openings separated by a portion of said front panel attached to the free end of said second wall, each said access openings closed by access cover plates, said receptacle enclosure access cover including a self-contained outwardly formed shield integral therewith, said shield adapted to extend above the base wall of the sleeve to define with a front flange thereof an opening for passage of the power cord therethrough, whereby upon securing on the sleeve the air conditioner room-side front assembly by screw fasteners said power cord is enclosed in accordance with electrical code standards.

2. An electrical subbase support casing for mounting the room-side end of an air conditioner wall sleeve upon a surface, said casing including an elongated box-shaped shell coextensive with the sleeve width formed from a one-piece blank of sheet metal comprising a rectangular base having upstanding end panels, a rear panel and a front panel; each said rear and front panel having a pair of attaching flanges extending from the side edges thereof secured to their associated end panels, a first L-shaped partition supported in said shell having a first receptacle wall extending from one end panel in intermediate parallel relation to said front and rear panels, and a second wall of said first partition extending forwardly at right angles from said first wall for attachment to said front panel, said L-shaped partition dividing said shell into a receptacle enclosure and a field wiring enclosure, said first wall having an electrical receptacle fixed thereto whereby a power cord plug from the control box of an air conditioner chassis is adapted to be mated with said receptacle, said shell base and rear panel each having at least one knockout aperture formed therein for attachment of a rigid power supply conduit to either said rear panel or base panel, said front panel having side-by-side access openings defining a front panel divider member attached to said second wall, each said access openings closed by an access cover plate, a second partition extending transversely in parallel relation to said second wall adjacent the opposite end panel, and said first partition receptacle wall and said second partitions having attaching flanges depending at right angles from their respective top edges, whereby the subbase can be secured to the sleeve base wall to provide a structural support for the room-side end thereof by means of a pair of screws extending through said attaching flanges.

3. An electrical subbase support casing for mounting the room-side end of an air conditioner wall sleeve upon a surface, said casing including an elongated Box-shaped shell coextensive with the sleeve width formed from a one-piece blank of sheet metal comprising a rectangular base having upstanding end panels, a rear panel and a front panel; each of said rear and front panels having a pair of attaching flanges extending from the side edges thereof welded to their associated end walls, a first L-shaped partition supported in said casing having a first wall extending from one end panel in intermediate parallel relation to said front and rear panels, and a second wall of said first partition extending forwardly at right angles from said first wall welded to said front panel, said L-shaped partition dividing said shell into a receptacle enclosure and a field wiring enclosure, said first wall having one-half of an electrical receptacle fixed thereto whereby a power cord plug from the control box of an air conditioner chassis is adapted to be plugged into said receptacle, said casing shell base and rear panel each having at least one knockout aperture for attachment of a rigid power supply conduit to either said rear panel or base, said front panel having side-by-side access openings defining a front panel divider welded to said second wall, each said access openings closed by access cover members, a second partition extending transversely in parallel relation to said second wall adjacent the opposite end panel, each of said first and third partitions having attaching flanges depending at right angles from the top edges thereof whereby the subbase can be secured to the base wall of said sleeve by means of screws extending through said attaching flanges, said receptacle enclosure access cover including a self-contained outwardly bowed shield integral therewith, said receptacle access cover having an angulated flange at its upper edge, and a portion of said angulated flange being lanced and shaped to provide an upper extension for said shield which extends above the base wall of the sleeve to define with a front portion thereof an entrance for the passage of the power cord therethrough, whereby upon securing on the sleeve the air conditioner room-side front assembly by screw fasteners said power cord is enclosed in accordance with electrical code standards.

* * * * *